US007427969B2

(12) United States Patent
Sasaki et al.

(10) Patent No.: US 7,427,969 B2
(45) Date of Patent: Sep. 23, 2008

(54) PLASMA DISPLAY APPARATUS

(75) Inventors: Takashi Sasaki, Kawasaki (JP); Yuichiro Kimura, Kawasaki (JP); Satoru Nishimura, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 700 days.

(21) Appl. No.: 10/924,992

(22) Filed: Aug. 25, 2004

(65) Prior Publication Data

US 2005/0116885 A1 Jun. 2, 2005

(30) Foreign Application Priority Data

Nov. 27, 2003 (JP) ..... 2003-397220

(51) Int. Cl.
*G09G 3/28* (2006.01)

(52) U.S. Cl. ..... 345/60; 345/63

(58) Field of Classification Search ..... 345/63, 345/60, 66–68, 690; 315/168.3, 169.4
See application file for complete search history.

(56) References Cited

U.S. PATENT DOCUMENTS

| | | | | |
|---|---|---|---|---|
| 6,373,452 | B1 | 4/2002 | Ishii et al. | 345/67 |
| 6,980,179 | B2 * | 12/2005 | Yatsuda et al. | 345/63 |
| 7,180,481 | B2 * | 2/2007 | Yamada | 345/63 |
| 2002/0130825 | A1 | 9/2002 | Kang | |
| 2002/0195970 | A1 | 12/2002 | Lim et al. | |
| 2003/0189533 | A1 | 10/2003 | Myoung et al. | |
| 2004/0027073 | A1 * | 2/2004 | Nomoto et al. | 313/583 |
| 2005/0088374 | A1 | 4/2005 | Kim et al. | |

FOREIGN PATENT DOCUMENTS

| | | |
|---|---|---|
| JP | A 11-65517 | 3/1999 |
| JP | A 2003-66897 | 3/2003 |
| KR | 2002-0085704 | 11/2002 |
| KR | 10-2005-0038974 | 4/2005 |

OTHER PUBLICATIONS

European Search Report, mailed Dec. 27, 2007 and issued in corresponding European Patent Application No. 04255114.3-1228.
Extended European Search Report, mailed Dec. 27, 2007 and issued in corresponding European Patent Application No. 07104931.6-1228.
Extended European Search Report, mailed Jan. 2, 2008 and issued in corresponding European Patent Application No. 07104933.2-1228.

* cited by examiner

*Primary Examiner*—Nguyen Chanh
*Assistant Examiner*—Allison Walthall
(74) *Attorney, Agent, or Firm*—Staas & Halsey LLP

(57) ABSTRACT

A high quality, three-electrode type plasma display apparatus, of which the display of low-luminance gradations has been improved by reducing the minimum luminance of the subfield, has been disclosed. In the plasma display apparatus, a subfield of even lower luminance is provided by: providing at least one subfield made up of only a reset period and an address period, without a sustain period, in one frame, and causing an address discharge to occur only between Y (second) electrodes and address (third) electrodes; or providing at least two second subfields made up of only a reset period and an address period in one frame, and making the intensity of an address discharge differ between the two second subfields.

7 Claims, 14 Drawing Sheets

PLASMA DISPLAY APPARATUS

BACKGROUND OF THE INVENTION

The present invention relates to an address/display separation system AC-type plasma display apparatus (PDP apparatus) used as a display unit of a personal computer or work station, a flat TV, or a plasma display for displaying advertisements, information, etc.

For an AC-type color PDP apparatus, an address/display separation system is widely employed, in which a period (an address period) during which cells to be used for display are selected and a display period (a sustain period) during which a discharge is caused to occur for light emission to produce a display are separated. In this system, charges are accumulated in the cells to be lit during the address period and a discharge is caused to occur for producing a display during the sustain period by the use of the charges.

PDP apparatuses include: a two-electrode type apparatus in which a plurality of first electrodes extending in a first direction are provided in parallel to each other and a plurality of second electrodes extending in a second direction perpendicular to the first direction are provided in parallel to each other; and a three-electrode type apparatus in which a plurality of first electrodes and a plurality of second electrodes each extending in a first direction are provided by turns in parallel to each other and a plurality of third electrodes extending in a second direction perpendicular to the first direction are provided in parallel to each other. Recently, the three-electrode type PDP has been widely used. The present invention can be applied not only to the two-electrode type PDP apparatus but also to the three-electrode type PDP apparatus. First, the three-electrode type PDP apparatus is taken as an example for an explanation here.

FIG. 1 is an exploded perspective view showing an example of a structure of a three-electrode type plasma display panel (PDP). As shown schematically, on a front substrate 1, X electrodes (first electrodes) 11 and Y electrodes (second electrodes) 12 between which a sustain discharge is caused to occur are arranged by turns in parallel to each other. These groups of electrodes are covered with a dielectric layer 13 and the surface thereof is further covered with a protective layer 14 such as MgO. On a back substrate 2, address electrodes 15 extending in a direction substantially perpendicular to the X electrodes 11 and the Y electrodes 12 are arranged and these electrodes are further covered with a dielectric layer 16. At both sides of the address electrodes 15, partitions 17 are arranged, defining the cells in the direction of column. Moreover, the dielectric layer 16 and the sides of the partitions 17 on the address electrodes 15 are coated with phosphors 18, 19 and 20 that are excited by ultraviolet rays to generate red (R), green (G) and blue (B) visible light. The front substrate 1 and the back substrate 2 are bonded together so that the protective layer 14 comes into contact with the partitions 17 and a discharge gas composed of neon (Ne), xenon (Xe), etc., is enclosed, and thus a panel is constructed.

In this structure, the X electrode 11 and the Y electrode 12 are each made of a bus electrode formed by a metal layer and a transparent electrode, and are arranged so that the transparent electrodes of a pair of the X electrode 11 and the Y electrode 12 are close to each other. A display cell is defined at the intersection of a pair of the X electrode 11 and the Y electrode 12 and the address electrode 15.

It is difficult for a plasma display panel to produce a gradated display by controlling the discharge intensity, therefore, one image (one frame: 1/60 sec) is made up of a plurality of subfields and a gradated display is produced by combining subfields to be lit for each cell. FIG. 2 is a diagram showing a conventional example of a subfield configuration, which is an example of the address/display separation system widely used in the current PDP apparatus. As shown schematically, one frame is made up of n subfields SF1-SFn. Each subfield has a reset period R, an address period A, and a sustain period S. During the reset period R, the charges formed during the sustain period in the immediately preceding subfield are erased (or reduced) and, at the same time, the charges are rearranged in order to support a discharge during the following address period, and all of the cells are brought into a substantially uniform state. During the address period A, an address discharge is caused to occur to determine cells to be lit and wall charges are formed in the cells to be lit in order to selectively cause a sustain discharge to occur. During the sustain period S, a sustain discharge is caused to occur repeatedly in the cells to be lit. The operations during the reset period R and the address period A are the same in each subfield. The display luminance is determined by the number of sustain pulses applied during the sustain period and in general the number of applied sustain pulses differs from subfield to subfield, but there may be a case where two or more subfields having the same or a similar number of sustain pulses, that is, two or more subfields having the same or a similar display luminance are provided in one frame. Moreover, as to how variously luminance-weighted subfields are arranged in each frame, various configurations have been proposed, but for the sake of simplicity, the following explanation is given on the assumption that subfields are arranged so that the luminance of a subfield is higher than that of the immediately preceding subfield. However, the present invention is not limited to the arrangement of subfields described above.

FIG. 3 is diagram showing a conventional example of drive waveforms in an address/display separation system three-electrode type PDP apparatus. During the reset period R, as shown schematically, in a state in which an on-cell reset voltage 87 is applied to the Y electrode, an on-cell reset obtuse wave 81, the voltage of which drops gradually, is applied to the X electrode, and thus the wall charges in a cell (a lit cell) in which a sustain discharge has been caused to occur in the preceding subfield are erased or reduced. This process is called the on-cell reset process. Next, in a state in which a write reset voltage 82 is applied to the X electrode, a write obtuse wave 88 is applied to the Y electrode to cause a discharge to occur in all of the cells, and thus the same wall charges are formed in the vicinity of the electrode. Moreover, in a state in which an adjusting voltage 83 is applied to the X electrode, an adjusting obtuse wave 89 is applied to the Y electrode to adjust the formed wall charges to a predetermined amount. Here, negative wall charges are formed in the vicinity of the Y electrode and positive wall charges are formed in the vicinity of the X electrode and in the vicinity of the address electrode. The reset process is described as above, and due to the reset process, all of the cells are brought into a uniform state. Although a predetermined amount of wall charges are left in all of the cells in order to make the process easier, during the following address period in the explanation described above, there are various examples of modifications such as one in which no wall charge is left.

There is a case where the process, in which the wall charges in a cell in which a sustain discharge has been caused to occur in the preceding subfield are erased or reduced, is included in the process during the sustain period, but it is assumed here, and in the following explanation, that the process in question is part of the process during the reset period. Either way, this process is performed between the sustain period and the reset period.

During the following address period A, in a state in which an X bias voltage 84 is applied to the X electrode and a Y bias voltage (non-selection potential) 90 is applied to the Y electrode, a scan pulse 91 having a voltage −Vs is applied to the Y electrode while the position of application is shifted sequentially and an address pulse 94 having a voltage VA is applied to the address electrode in the cells to be lit in synchronization with the scan pulse 91. Due to this, a large voltage VA+Vs is applied between the Y electrode and the address electrode in the cells to be lit, therefore, an address discharge is caused to occur therein. At this time, a large electric field is formed also between the X electrode and the Y electrode, therefore, an address discharge is caused to occur also between the Y electrode and the X electrode induced by the address discharge between the Y electrode and the address electrode. Because of the transition of the address discharge between the Y electrode and the address electrode to that between the Y electrode and the X electrode, wall charges having the polarity opposite to that of the voltage applied to the respective electrodes are accumulated in the vicinity of the Y electrode and the X electrode. These wall charges are used to selectively cause a subsequent sustain discharge to occur. It is assumed here that the X bias voltage 84 is Vx, the Y bias voltage (non-selection potential) 90 is a negative voltage −Vy, the voltage of the scan pulse 91 is −Vs, and the voltage of the address pulse 94 is VA. These voltages are set so that an address discharge is caused to occur in the cells to which the scan pulse 91 and the address pulse 94 have been applied simultaneously and no discharge is caused to occur in the other cells, and in the cells in which an address discharge has been caused to occur (in the lit cells), wall charges capable of selectively causing a subsequent sustain discharge to occur are formed in the vicinity of the X electrode and the Y electrode. The wall charges left in all of the cells at the end of the reset period will serve to cause an address discharge to occur without fail even if a voltage to be applied between the Y electrode and the address electrode by the scan pulse 91 and the address pulse 94 is small. The wall charges in the cells in which no address discharge has been caused to occur (the wall charges formed during the reset period) are retained until a subsequent discharge is caused to occur. Here, an example is explained, in which an address discharge is caused to occur in the cells to be lit and wall charges required to selectively causing a sustain discharge to occur are formed, but there may be a case where uniform wall charges are formed in all of the cells during the reset period and the wall charges are erased in the cells not to be lit by causing an address discharge to occur.

During the following sustain period, a sustain pulse 85 having the voltage −Vs is applied to the X electrode and a sustain pulse 92 having a voltage Vs is applied to the Y electrode. Due to this, a voltage 2Vs is applied between the X electrode and the Y electrode. In the cells in which an address discharge has been caused to occur, the voltage due to the wall charges formed by the address discharge is added to ZVs, therefore, the discharge start voltage is exceeded and a sustain discharge is caused to occur. In the cells in which no address discharge has been caused to occur, no sustain discharge is caused to occur. In the cells in which a sustain discharge has been caused to occur, wall charges having the opposite polarity are formed by the sustain discharge. Next, when a sustain pulse 86 having the voltage Vs is applied to the X electrode and a sustain pulse 93 having the voltage −Vs is applied to the Y electrode, in the lit cells in which a sustain discharge has been caused to occur, the voltage due to the wall charges having the opposite polarity formed by the sustain discharge is added and a subsequent sustain discharge is caused to occur, but no discharge is caused to occur in the unlit cells in which no sustain discharge has been caused to occur. As described above, because the application of a sustain pulse reverses the polarity of the wall charges to be formed, a sustain discharge is caused to occur continuously in the lit cells by applying a sustain pulse having the opposite polarity alternately to the X electrode and the Y electrode.

The luminance of a subfield is set by the number of sustain discharges. As shown in FIG. 3, two sustain discharges are caused to occur in SF1 and four sustain discharges are caused to occur in SF2, and in a subfield whose luminance is higher, the number of sustain discharges is further increased. As the period of a sustain pulse is constant, in general, the length of the sustain period is determined by the number of sustain discharges. By the way, in an AC type PDP, as two discharges that reverse the polarity make a pair, in general, the number of sustain discharges is increased by a factor of a multiple of 2.

Here, a discharge in a PDP is explained. A discharge for forming a predetermined amount of wall charges in all of the cells during the reset period, in other words, a discharge by the reset voltage 82 and the write obtuse wave 88 and a discharge by the adjusting voltage 83 and the adjusting obtuse wave 89 do not relate to a display and light emission caused by these discharges is the same in all of the cells, therefore, the contrast is reduced as a result. Although not shown in FIG. 3, there may be a case where an initialization discharge is caused to occur in all of the cells by applying a large voltage for initialization between the X electrode and the Y electrode, and in this case also, such a discharge does not relate to a display and the contrast is reduced as a result. It is therefore desirable that such discharges are as weak as possible. Because of this, an initialization discharge is not caused to occur, if possible. Moreover, a discharge for forming a predetermined amount of wall charges is reduced considerably in light emission intensity by using the above-mentioned obtuse wave.

A discharge by the on-cell reset process for erasing or reducing the wall charges in the cells lit in the preceding subfield during the reset period, in other words, a discharge by the on-cell reset voltage 87 and the on-cell reset obtuse wave 81 is a discharge that relates to the display in the preceding subfield. Moreover, an address discharge and a sustain discharge are charges that relate to a display.

Conventionally, as to the luminance of each field, only the light emission luminance due to a sustain discharge is considered in general. On the other hand, erasure of charges is performed by a discharge small in the intensity by using an obtuse wave, such as a discharge by the on-cell reset voltage 87 and the on-cell reset obtuse wave 81.

The quality of display of a PDP apparatus has been improved yearly, but improvement is still demanded and the improvement in displaying performance of low-luminance gradations is particularly demanded. Japanese Unexamined Patent Publication (Kokai) 11-65517 has described the necessity to consider the luminance by other discharges that relate to a gradated display, whereas only the light emission luminance by a sustain discharge is considered conventionally.

When a gradated display is produced in an AC type color plasma display by combining subfields of different luminance, the displaying performance of low-luminance gradations is determined by the luminance of a subfield having the lowest luminance. The above-mentioned Japanese Unexamined Patent Publication (Kokai) No. 11-65517 and Japanese Unexamined Patent Publication (Kokai) No. 2003-66897 have described a configuration in which subfields made up of only a reset period and an address period, without a sustain period, are provided.

FIG. 4 is a diagram showing a subfield configuration when a subfield having no sustain period is provided in a frame, and FIG. 5 is a diagram showing an example of drive waveforms in SF1 and SF2 in such a case. FIG. 5 shows an example, in which the configuration described in Japanese Unexamined Patent Publication (Kokai) No. 11-65517 and Japanese Unexamined Patent Publication (Kokai) No. 2003-66897 is applied to the drive waveforms in FIG. 3. As shown in FIG. 4 and FIG. 5, the SF1 has only the reset period R and the address period A. Due to this, the luminance of the SF1 can be reduced and the displaying performance of low-luminance gradations can be improved. As shown in FIG. 5, the operation during the address period in SF1 and the operation during the address period in SF2 are the same.

SUMMARY OF INVENTION

As described above, by providing a subfield made up of only the reset period and the address period, without the sustain period, the displaying performance of low-luminance gradations can be improved but still more improvement is demanded.

The object of the present invention is to realize a plasma display apparatus in which the displaying of low-luminance gradations has been further improved.

In order to realize the above-mentioned object, a plasma display apparatus (a PDP apparatus) according to a first aspect of the present invention is a three-electrode type PDP apparatus, in which at least one subfield made up of only a reset period and an address period, without a sustain period, is provided in one frame and an address discharge is caused to occur only between Y (second) electrodes and address (third) electrodes. Due to this, the minimum luminance of the subfield is reduced and the displaying performance of low-luminance gradations of the plasma display apparatus can be further improved.

In other words, the PDP apparatus according to the first aspect of the present invention, comprising first and second groups of electrodes arranged on a first substrate in parallel to each other and a third group of electrodes arranged on a second substrate facing the first substrate so as to intersect the first and second groups of electrodes, is characterized in that: one frame is made up of a plurality of subfields; the plurality of subfields include first subfields having an address period during which an address discharge is caused to occur to select cells to be lit and a sustain period during which a sustain discharge is caused to occur in the cells elected during the address period and second subfields having the address period but not the sustain period; during the address period in the first subfields, after the address discharge is caused to occur between the second group of electrodes and the third group of electrodes, the address discharge is caused to occur between the first group of electrodes and the second group of electrodes; and during the address period in the second subfields, the address discharge is caused to occur between the second group of electrodes and the third group of electrodes, without the transition of this address discharge to that between the first group of electrodes and the second group of electrodes.

Moreover, in order to realize the above-mentioned object, in a PDP apparatus according to a second aspect of the present invention, at least two second subfields made up of only a reset period and an address period are provided in one frame and the two second subfields are made to differ from each other in the address discharge intensity and thus a subfield of lower luminance is provided.

In other words, the PDP apparatus according to the second aspect of the present invention is characterized in that: one frame is made up of a plurality of subfields; the plurality of subfields include first subfields having an address period during which an address discharge is caused to occur to select cells to be lit and a sustain period during which a sustain discharge is caused to occur in the cells selected during the address period and second subfields having the address period but not the sustain period; and the plurality of subfields include at least the two second subfields of different intensity of the address discharge.

According to the above-mentioned Japanese Unexamined Patent Publication (Kokai) No. 11-65517 and Japanese Unexamined Patent Publication (Kokai) No. 2003-66897, as shown in FIG. 5, during the address period in the subfield having only the reset period and the address period, the same process is performed as that during the address period in the subfield having the sustain period and wall charges are formed in order to selectively cause a sustain discharge to occur. Therefore, the address discharge intensity is almost as high as that of a pair of sustain discharges, because an address discharge is caused to occur twice between the Y (second) electrode and the address (third) electrode and between the X (first) electrode and the Y electrode. However, in the case of the second subfield not having the sustain period, it is not necessary to form wall charges in order to selectively cause a sustain discharge to occur, therefore, the address discharge intensity can be further reduced. Due to this, the luminance of the subfield can be further reduced. As described above, as it is no longer necessary to form wall charges in order to selectively cause a sustain discharge to occur, the address discharge intensity can be set arbitrarily and a subfield of even lower luminance than before can be provided by altering the address discharge intensity.

The present invention can be applied to the three-electrode type PDP apparatus explained in FIG. 1 and to any two-electrode type PDP apparatus provided that the PDP apparatus employs the address/discharge separation system.

In the case of the three-electrode type PDP apparatus described in Japanese Unexamined Patent Publication (Kokai) No. 11-65517 and Japanese Unexamined Patent Publication (Kokai) No. 2003-66897, during the address period, a large voltage is applied between the group of X electrodes and the group of Y electrodes and once an address discharge is caused to occur by a scan pulse and an address pulse, induced by this discharge, an address discharge is caused to occur also between the X electrodes and the Y electrodes and wall charges in order to selectively cause a sustain discharge to occur are formed in the vicinity of the X and Y electrodes. In contrast to this, if a voltage to be applied between the group of X electrodes and the group of Y electrodes is reduced so that an address discharge is prevented from occurring between the X electrodes and the Y electrodes even if an address discharge occurs between the Y electrodes and the address electrodes, the address discharge intensity is reduced and the luminance can be reduced. In other words, one subfield of low-luminance not having the sustain period is provided so that a discharge is prevented from occurring between the X electrodes and the Y electrodes at the time of an address discharge.

As described above, the luminance of the subfield can be further reduced, therefore, if, for example, at least two subfields of low luminance having no sustain period are provided and one of them is made to have the address period under the same condition as that in the subfield having the sustain period, that is, the subfield is used to form wall charges for a sustain discharge, and the other subfield is used as a subfield of lower luminance in which no address discharge is caused to occur between the X electrodes and the Y electrodes, it is possible to provide a plurality of subfields of low and different luminance.

Moreover, it is no longer necessary to form wall charges in order to selectively cause a sustain discharge to occur and, therefore, the intensity of an address discharge between the Y electrodes and the address electrodes can be reduced. The intensity of an address discharge between the Y electrodes and the address electrodes can be reduced by reducing the absolute value of a voltage between the Y electrodes and the address electrodes when an address pulse and a sustain pulse are applied simultaneously. To be specific, the voltage of an address pulse or a scan pulse or the voltages of both are changed.

It is also possible to further increase the number of the steps of the luminance in the low-luminance subfields by changing the intensity of an address discharge between the X electrode and the Y electrode and an address discharge between the Y electrode and the address period in smaller steps and by combining the amounts of change.

In the case of the two-electrode type PDP apparatus, the absolute value of a voltage is reduced between the first electrodes (the transverse electrodes) and the second electrodes (the longitudinal electrodes) when an address pulse and a sustain pulse are applied simultaneously.

BRIEF DESCRIPTION OF THE DRAWINGS

The features and advantages of the invention will be more clearly understood from the description taken in conjunction with the accompanying drawings, in which.

DESCRIPTION OF THE PREFERRED EMBODIMENTS

Figure 1:
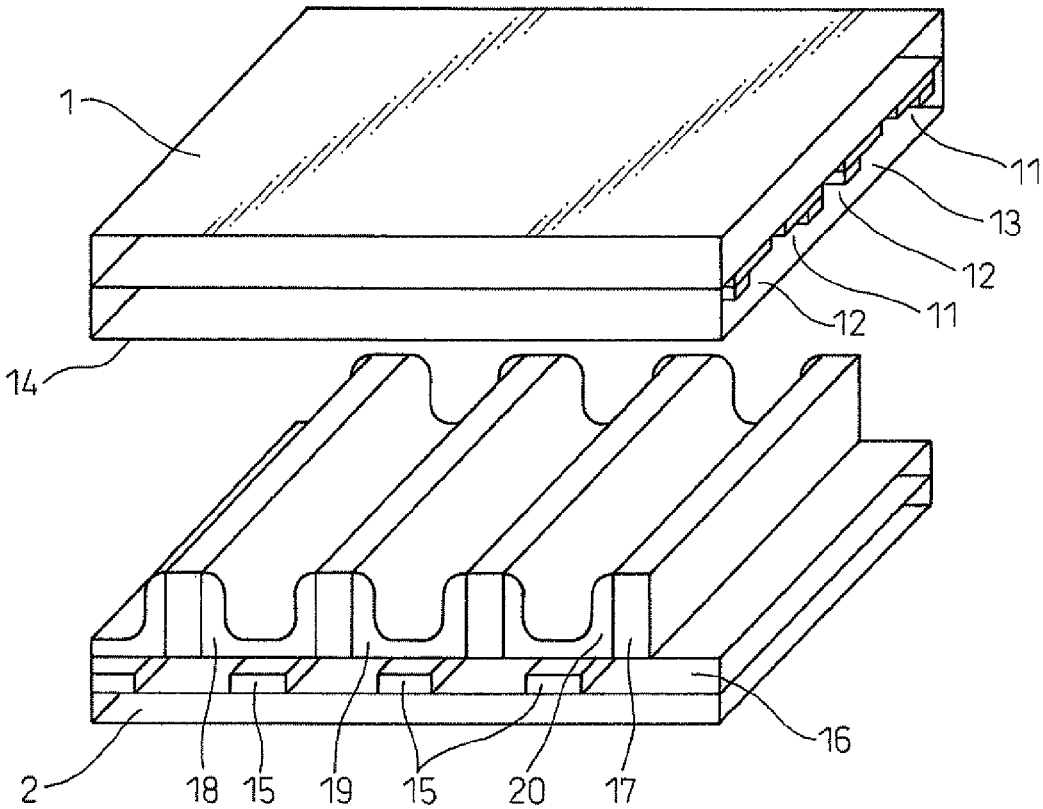
FIG. 1 PRIOR ART
FIG. 1 is an exploded perspective view of a three-electrode type PDP.
Figure 6:
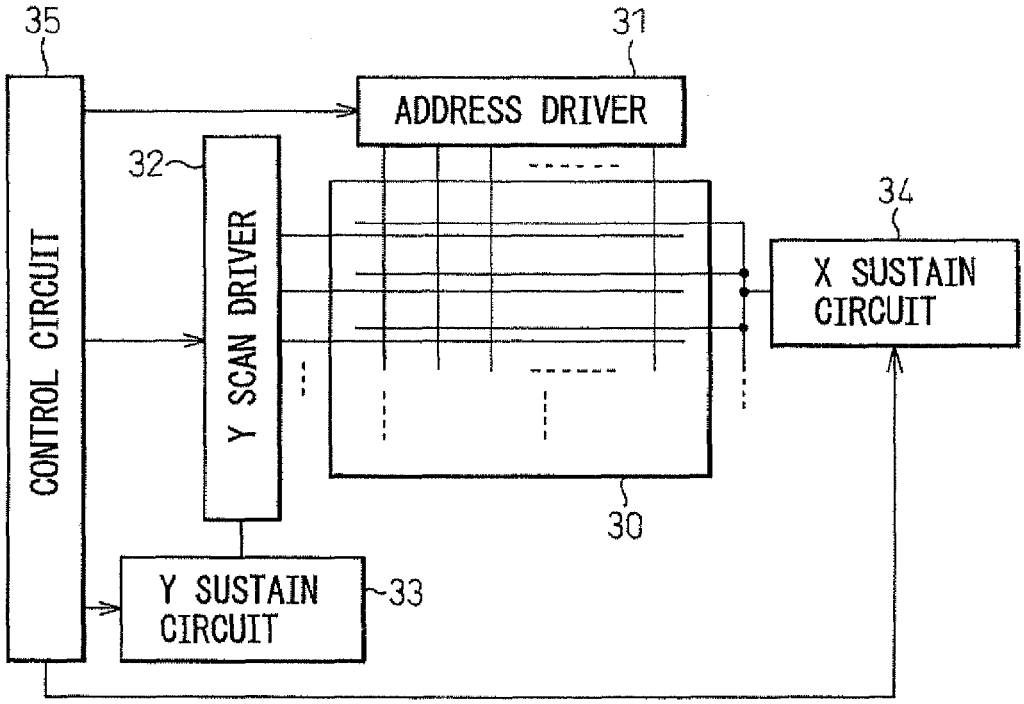
FIG. 6 is a diagram showing a general configuration of a PDP apparatus in a first embodiment of the present invention.

FIG. 6 is a diagram showing the general configuration of the plasma display apparatus (PDP apparatus) in the first embodiment of the present invention. A plasma display panel (PDP) 30 has a configuration shown in FIG. 1. An address driver 31 applies an address pulse having a ground level or a voltage Va to each address electrode 15. A Y scan driver 32 applies a scan pulse having a voltage −Vs sequentially to each Y electrode and at the same time, commonly applies a predetermined voltage such as a sustain pulse supplied via a Y sustain circuit 33 to all of the second electrodes (Y electrodes) 12. An X sustain circuit 34 commonly applies a predetermined voltage such as a sustain pulse to the first electrodes (X electrodes) 11. A control circuit 35 controls each component described above.

The PDP apparatus in the first embodiment has a conventional configuration widely known and one frame is made up of a plurality of subfields, but the drive waveforms in subfields of low-luminance are different. No more detailed explanation of the configuration of the PDP apparatus is given here but only the drive waveforms are explained below.

Figure 7:
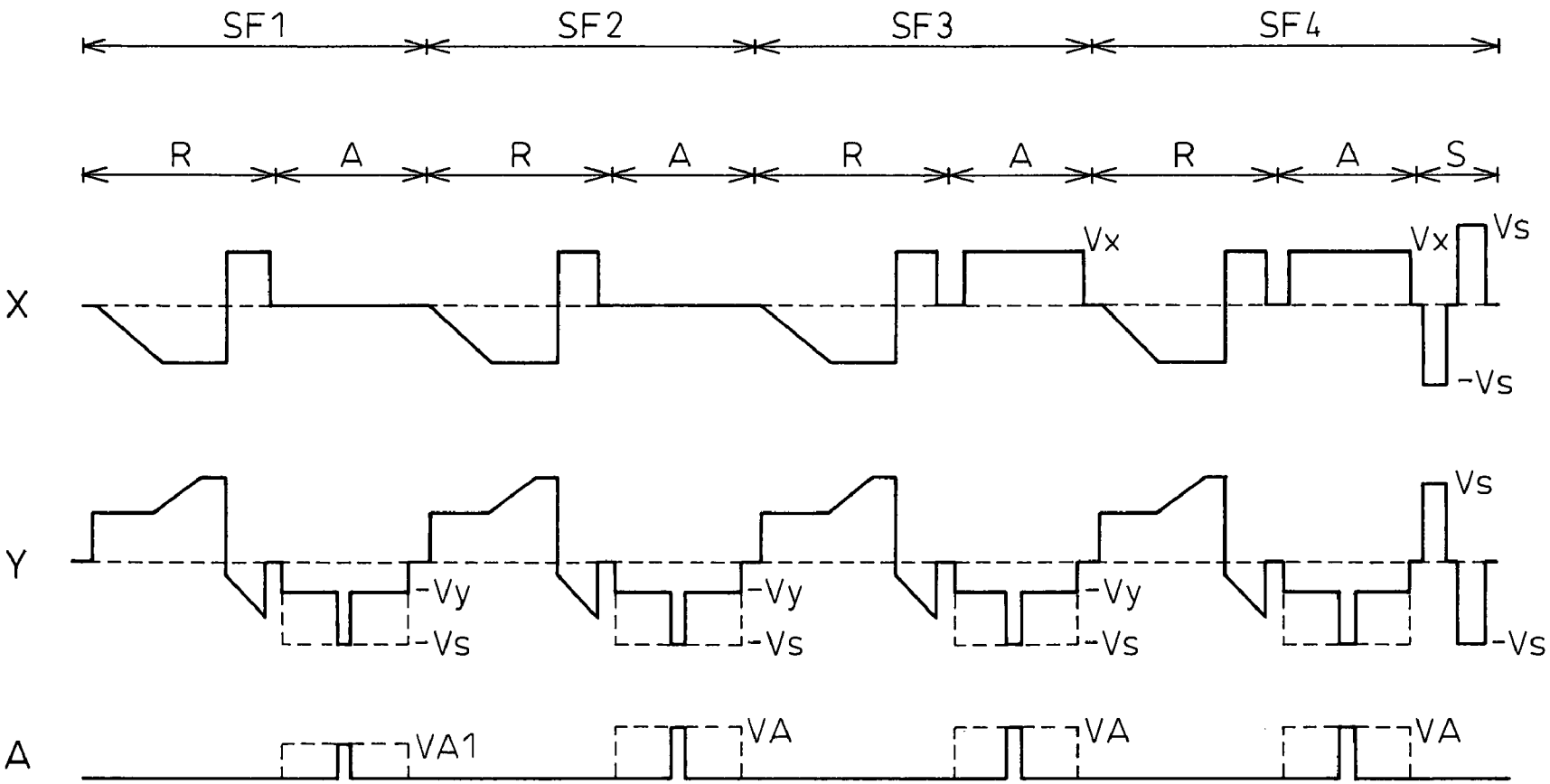
FIG. 7 is a diagram showing drive waveforms of the PDP apparatus in the first embodiment.

FIG. 7 is a diagram showing the drive waveforms in the PDP apparatus in the first embodiment, or to be specific, the drive waveforms in the subfields SF1-SF4 of lower luminance. The subfield SF5 and the following subfields of higher luminance have the same drive waveforms as those in SF4 and only the number of sustain pulses is different.

Figure 3:
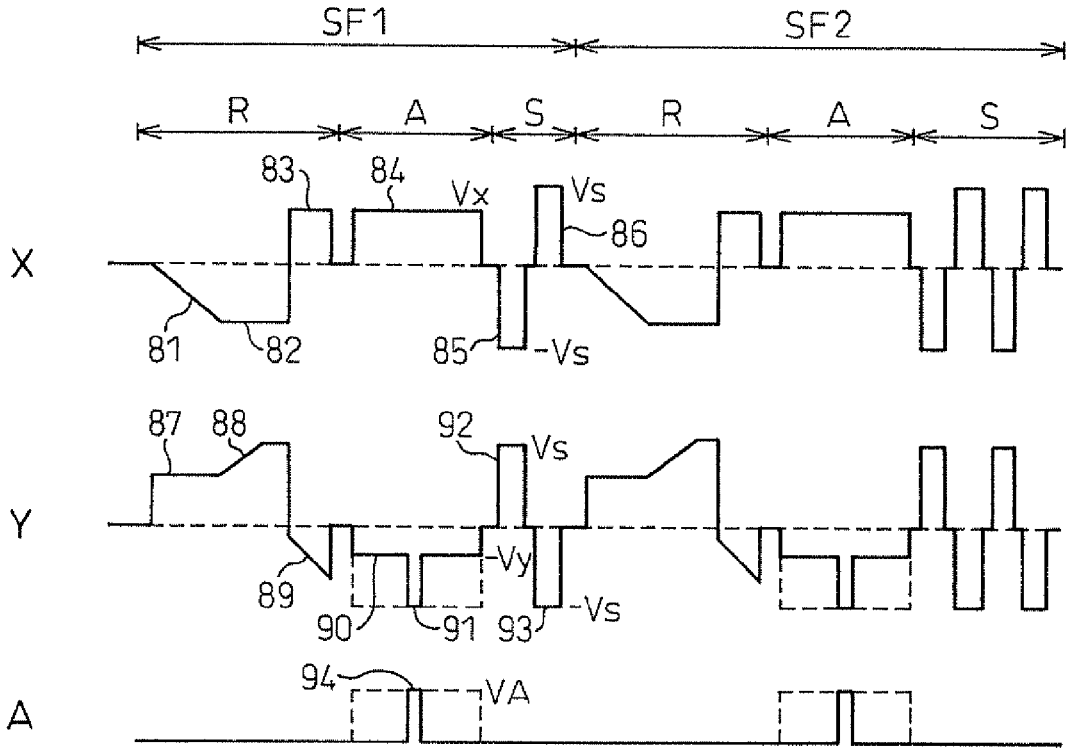
FIG.3 PRIOR ART
FIG. 3 is a diagram showing a conventional example of drive waveforms.
Figure 4:
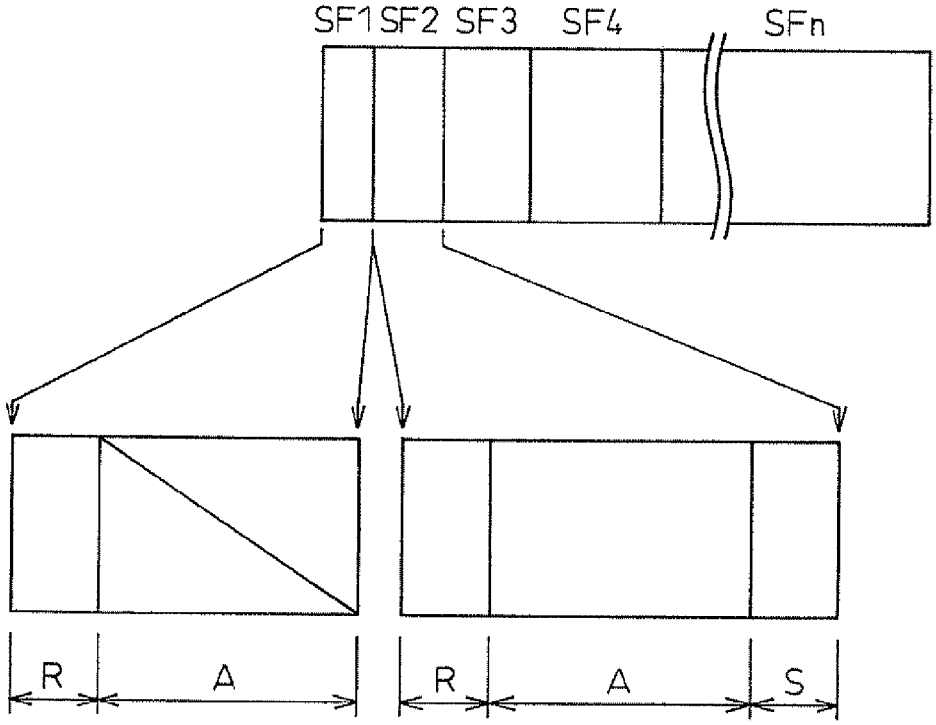
FIG.4 PRIOR ART
FIG. 4 is a diagram showing another conventional example of a field configuration.
Figure 5:
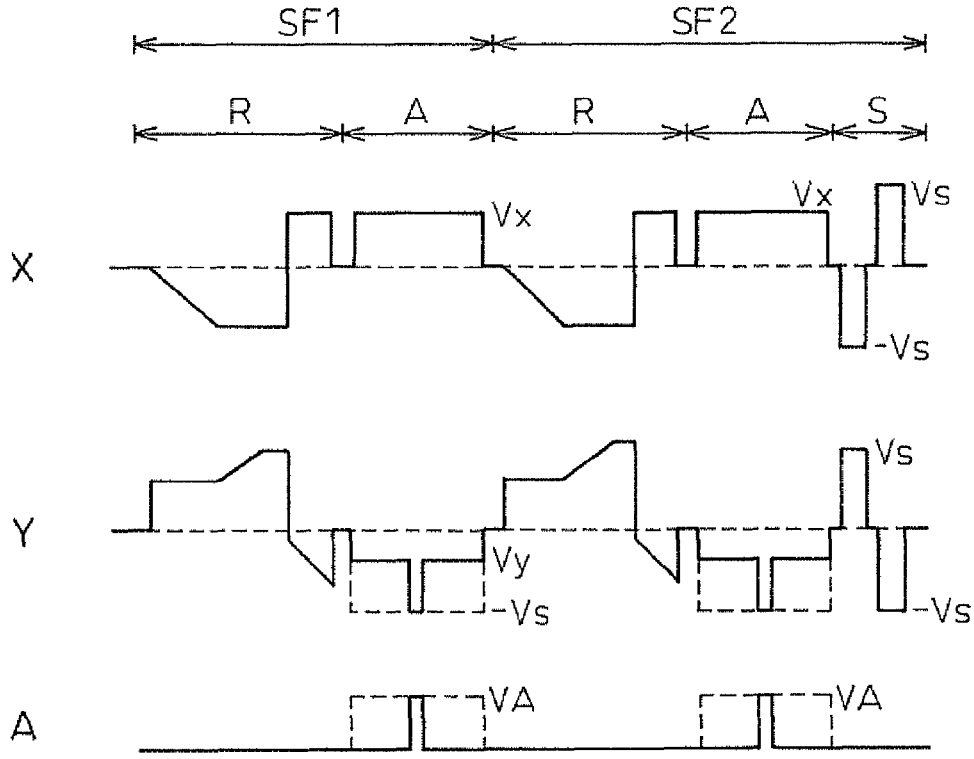
FIG.5 PRIOR ART
FIG. 5 is a diagram showing another example of drive waveforms.

As obvious from the comparison with the conventional drive waveforms shown in FIG. 5, SF3 and SF4 in the first embodiment have the same drive waveforms as those in the conventional SF1 and SF2 shown in FIG. 5. Therefore, the operation performed in SF4 is the same as that explained with reference to FIG. 3 and in SF3, the operation in SF4 excluding the operation during the sustain period is performed. Neither SF1 nor SF2 has a sustain period.

In SF2, the operation during the reset period R is the same as that during the reset period R in SF3 and SF4. Then, during the address period A, in a state in which a ground potential is applied to the X electrode and the Y bias voltage (non-selection potential) −Vy is applied to the Y electrode, a scan pulse having the voltage −Vs is applied sequentially to the Y electrode while the position of application is shifted, and an address pulse having the voltage VA is applied to the address electrode in synchronization with the scan pulse. No sustain period is provided in SF2 as in SF3. In other words, while the voltage Vx is applied to the X electrode in SF3 and SF4, the ground potential is applied in SF2 in the first embodiment.

As the voltage Vx is applied to the X electrode in SF3 and SF4, a large voltage Vx+Vs is applied between the Y electrode to which a scan pulse is applied and the X electrode and when an address discharge is caused to occur between the Y electrode and the address electrode in the cells to be lit to which a scan pulse and an address pulse have been applied simultaneously, induced by this address discharge, an address discharge is caused to occur also between the Y electrode and the X electrode (the transition of the address discharge between the Y electrode and the address electrode to that between the Y electrode and the X electrode), and positive wall charges are formed in the vicinity of the Y electrode and negative charges are formed in the vicinity of the X electrode. In SF4, a sustain discharge is caused to occur selectively by using the wall charges. Therefore, the intensity of an address discharge in SF3 and SF4 is the sum of the intensity of a discharge between the Y electrode and the address electrode and the intensity of a discharge between the Y electrode and the X electrode, and the luminance due to an address discharge will also be the sum of the luminance due to two discharges.

As the ground potential is applied to the X electrode in SF2, only the voltage Vs is applied between the Y electrode to which a scan pulse is applied and the X electrode and therefore even if an address discharge is caused to occur, no discharge is induced between the Y electrode and the Y electrode. Because of this, an address discharge is caused to occur only between the Y electrode and the address electrode and therefore the luminance due to the address discharge is lower than that of SF3 and SF4. As no address discharge is caused to occur between the Y electrode and the X electrode during the address period in SF2, wall charges for selectively causing a sustain discharge to occur are not formed in the vicinity of the Y electrode and in the vicinity of the X electrode, but this will not bring about any problem because SF2 does not have the sustain period.

The luminance was 0.97 cd/$m^2$ when an address discharge was caused to occur actually in SF3 and SF4, where Vs=80V, Vx=80V and VA=60V, and the luminance was 0.36 cd/$m^2$ when an address discharge was caused to occur in SF2, where Vx=0V, and thus the luminance could be more than halved.

The operation during the reset period in SF1 is the same as that during the reset period R in SF2 to SF4. Then, during the address period A, in a state in which the ground potential is applied to the X electrode and a voltage Vy is applied to the Y electrode, a scan pulse having the voltage −Vs is applied sequentially to the Y electrode while the position of application is shifted and an address pulse having a voltage VA1 is applied to the address electrode in synchronization with the scan pulse. As in SF2 and SF3, no sustain period is provided in SF1. In other words, while an address pulse having the voltage VA is applied in SF2, an address pulse having the voltage VA1 lower than the voltage VA is applied in SF1.

As in SF2, therefore, no address discharge is caused to occur between the Y electrode and the X electrode. Moreover, as the voltage VA1 of an address pulse is lower than the voltage VA, the intensity of an address discharge between the Y electrode and the address electrode is smaller in SF1 and therefore the luminance of SF1 is lower than the luminance of SF2.

As described above, in the subfield configuration of the PDP apparatus in the first embodiment, three subfields of different luminance even lower than the minimum luminance of the subfield having the sustain period are provided. Moreover, in comparison with the conventional subfield configuration shown in FIG. 5, two subfields of different smaller luminances are further provided. Because of this, the display of low-luminance gradations is improved.

Figure 8:
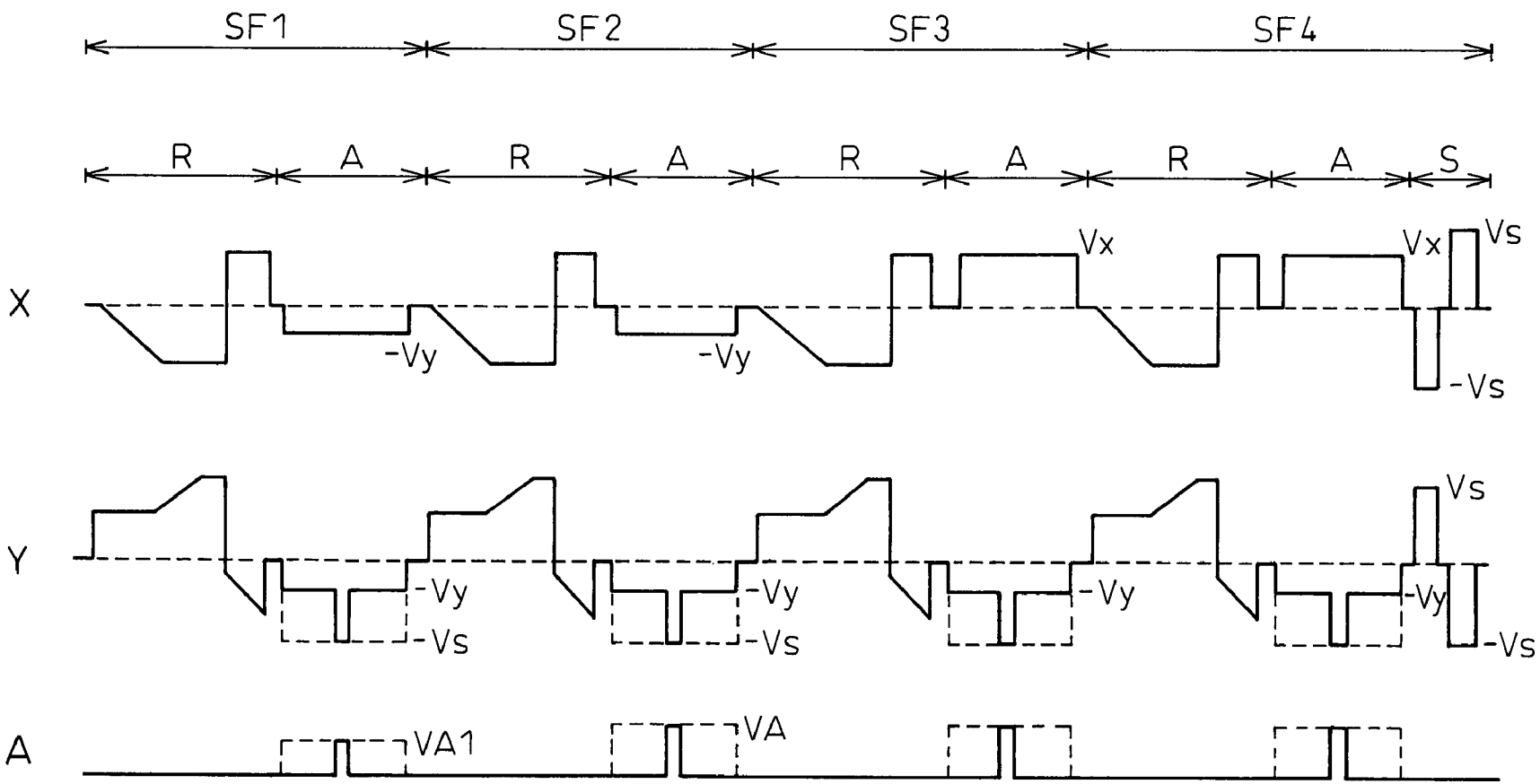
FIG. 8 is a diagram showing an example of a modification of the drive waveforms of the PDP apparatus in the first embodiment.

In the drive waveforms in the first embodiment shown in FIG. 7, the potential of the X electrode is set to the ground level during the address period in SF1 and SF2. However, the potential of the X electrode is not limited to the ground level provided that the voltage will not cause an address discharge to occur between the Y electrode and the X electrode induced by an address discharge between the Y electrode and the address electrode. FIG. 8 is a diagram showing an example of a modification of the drive waveform, in which the potential of the X electrode during the address period is changed. In this modification, the potential of the X electrode during the address period is set to the Y bias voltage (non-selection potential) −Vy to be applied to the Y electrodes other than those to which a scan pulse is applied during the address period. Due to this, the possibility that an address discharge is caused to occur between the Y electrode and the X electrode induced by an address discharge between the Y electrode and the address electrode can be further reduced.

Figure 9:
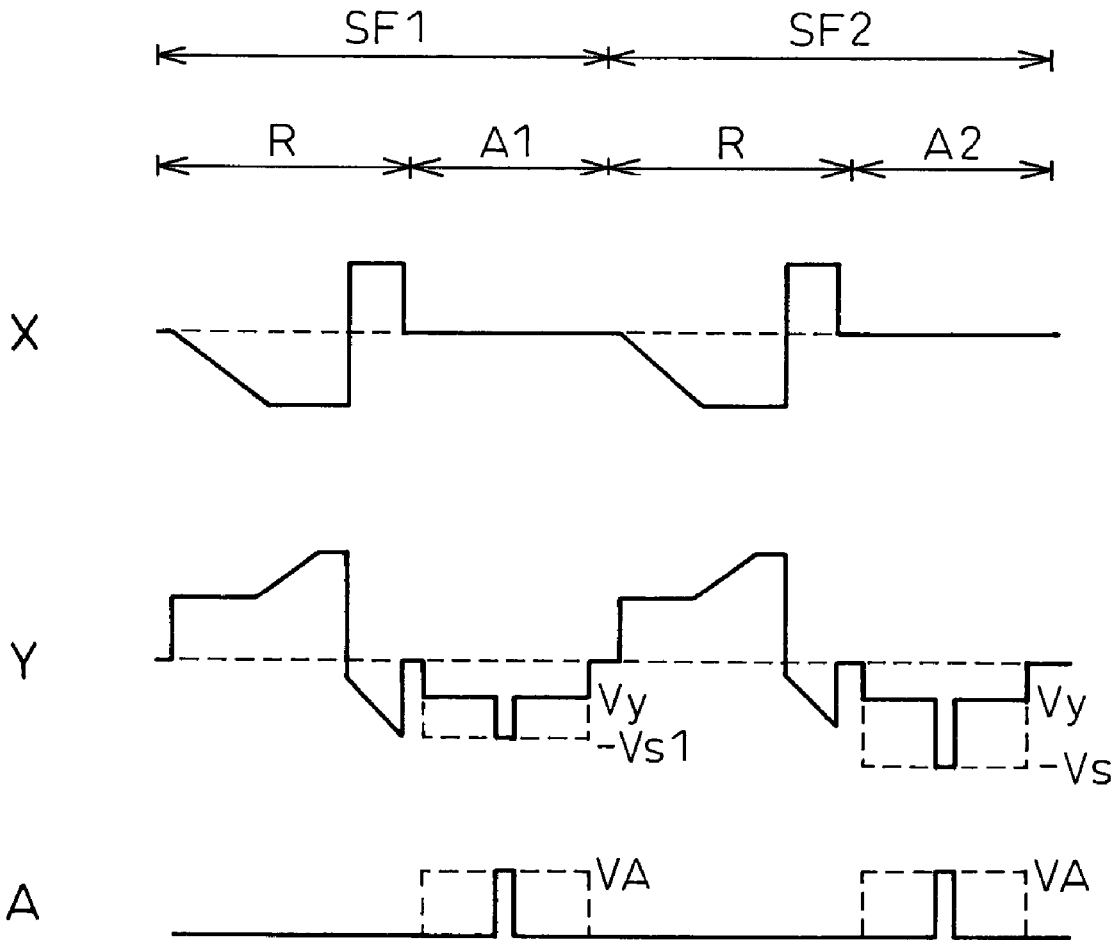
FIG. 9 is a diagram showing another example of a modification of the drive waveforms of the PDP apparatus in the first embodiment.

In the drive waveforms in the first embodiment shown in FIG. 7, the voltage of an address pulse is set to the voltage VA1 in SF1 and thus the intensity of an address discharge between the Y electrode and the address electrode is reduced. However, as shown in FIG. 9, it is also possible to reduce the intensity of an address discharge by setting the voltage of an address pulse to VA and the voltage of a scan pulse to −Vs1 (Vs1 is smaller than Vs) and by reducing the voltage between the Y electrode and the address electrode when an address pulse and a scan pulse are applied simultaneously.

Figure 10:
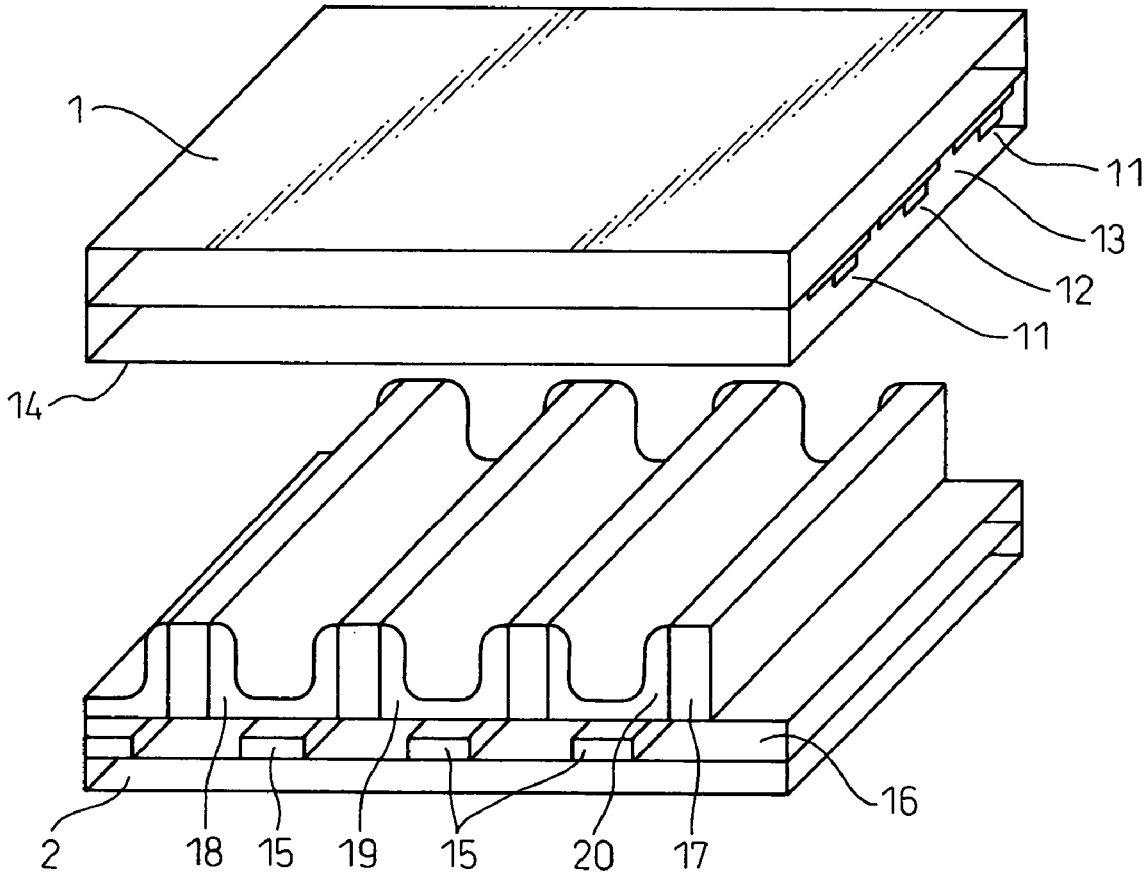
FIG. 10 is an exploded perspective view of a PDP used in a second embodiment of the present invention.
Figure 11:
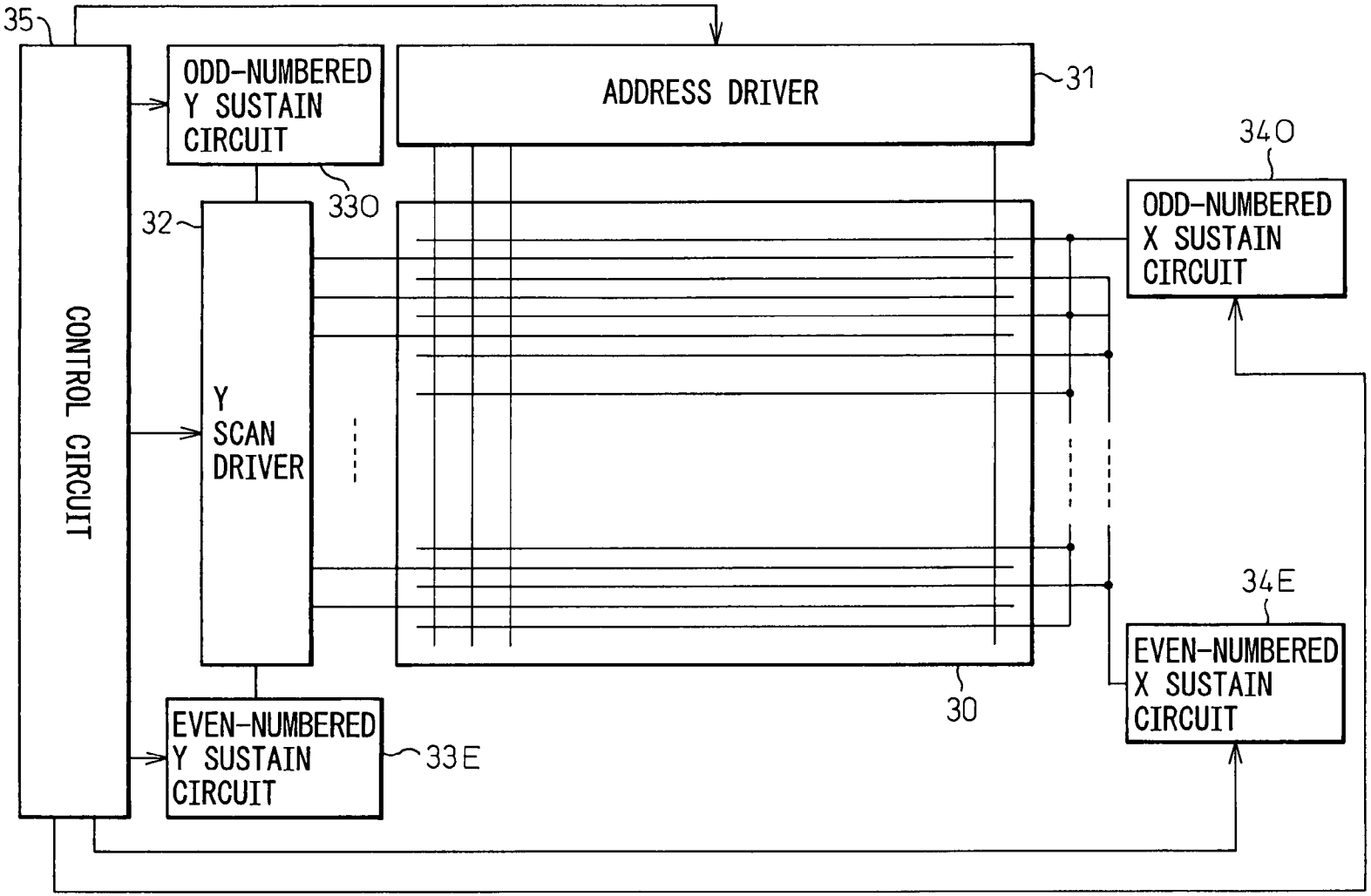
FIG. 11 is a diagram showing a general configuration of a PDP apparatus in the second embodiment.

FIG. 10 is an exploded perspective view of a PDP used in the PDP apparatus according to the second embodiment of the present invention, and FIG. 11 is a diagram showing the general configuration of the PDP apparatus in the second embodiment. The second embodiment is an embodiment in which the present invention is applied to an ALIS system PDP apparatus described in U.S. Pat. No. 6,373,452. As the ALIS system PDP apparatus, in which n+1 X electrodes 11 and n Y electrodes 12 are equally spaced and a discharge is caused to occur between the respective opposite sides of each Y electrode 12 and the adjacent, respective X electrodes 11 and 2n display lines are defined, is described in U.S. Pat. No. 6,373,452, no detailed explanation is given here. Therefore, a discharge is caused to occur also between the respective opposite sides of each X electrode 11 and the respective, adjacent Y electrodes 12. In an ALIS system PDP apparatus, an interlaced display is produced and the odd-numbered display lines of the 2n display lines are displayed in the odd number field and the even-numbered display lines are displayed in the even number field. The odd-numbered display lines are defined between the odd-numbered X electrodes and the odd-numbered Y electrodes and between the even-numbered X electrodes and the even-numbered Y electrodes, and the even-numbered display lines are defined between the odd-numbered Y electrodes and the even-numbered X electrodes and between the even-numbered Y electrodes and the odd-numbered X electrodes.

Figure 2:
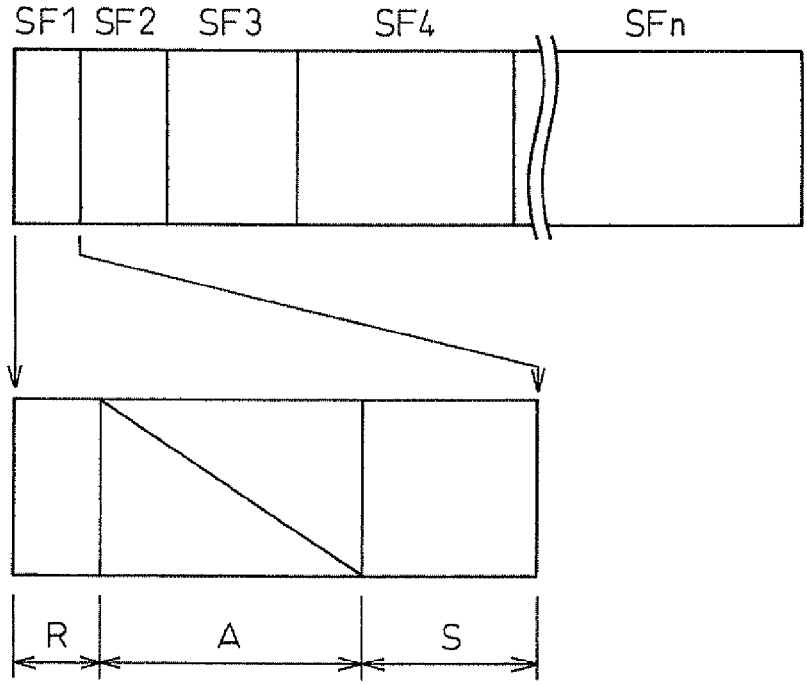
FIG. 2 PRIOR ART
FIG. 2 is a diagram showing a conventional example of a field configuration.

As shown in FIG. 10, the ALIS system PDP has a configuration similar to that of the PDP shown in FIG. 2 except in that the X electrodes 11 and the Y electrodes are equally spaced. As shown in FIG. 11, the address driver 11 drives the address electrodes 15. The Y scan driver 32 applies a voltage supplied from an odd number Y sustain circuit 330 commonly to the odd-numbered Y electrodes and applies a voltage supplied from an even number sustain circuit 33E commonly to the even-numbered Y electrodes as well as applying a scan pulse to each Y electrode 12. An odd number X sustain circuit 340 applies a voltage commonly to the odd-numbered X electrodes and an even number X sustain circuit 34E applies a voltage commonly to the even-numbered X electrodes. The control circuit 35 controls each component.

Figure 12:
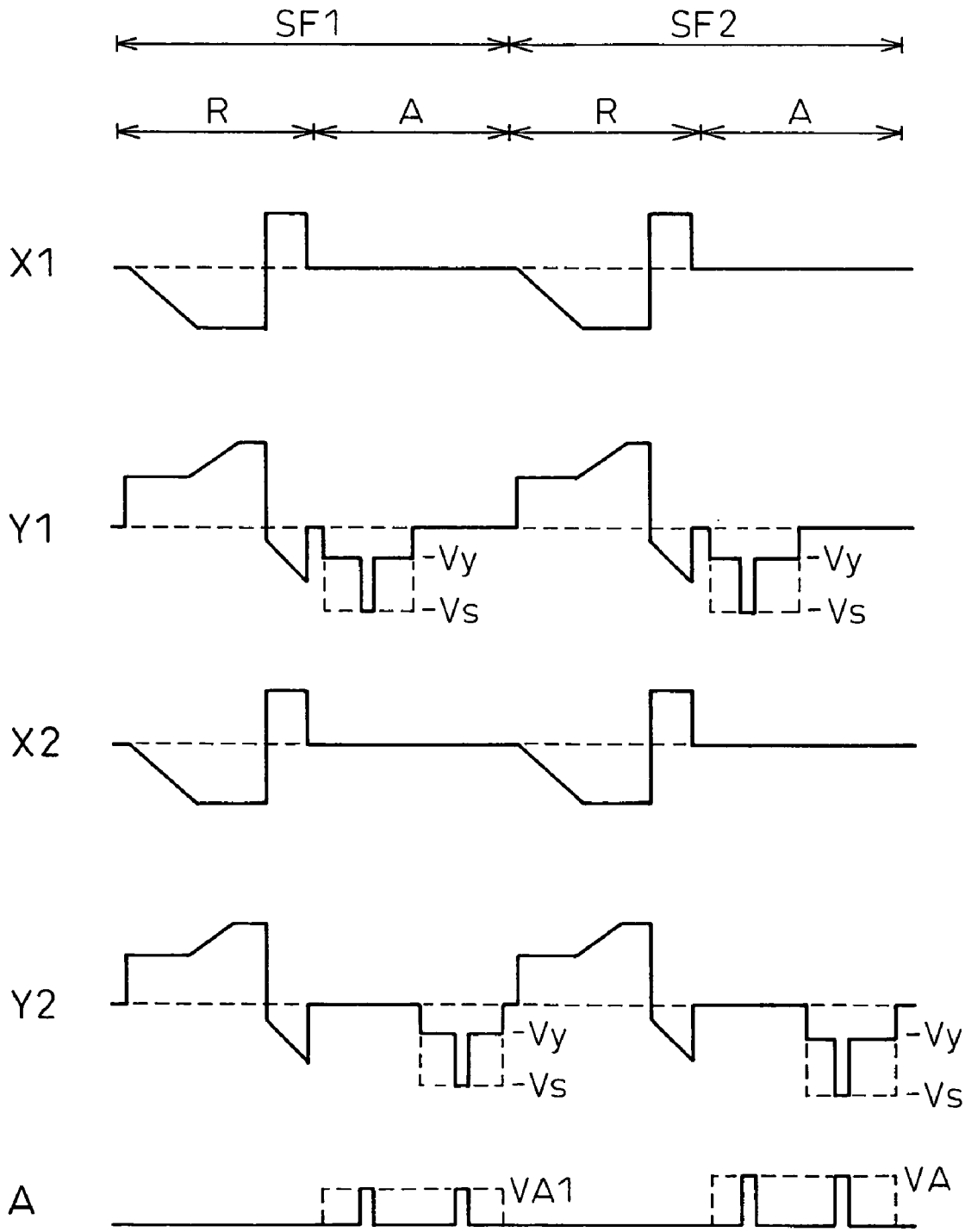
FIG. 12 is a diagram showing drive waveforms of the PDP apparatus in the second embodiment.
Figure 13:
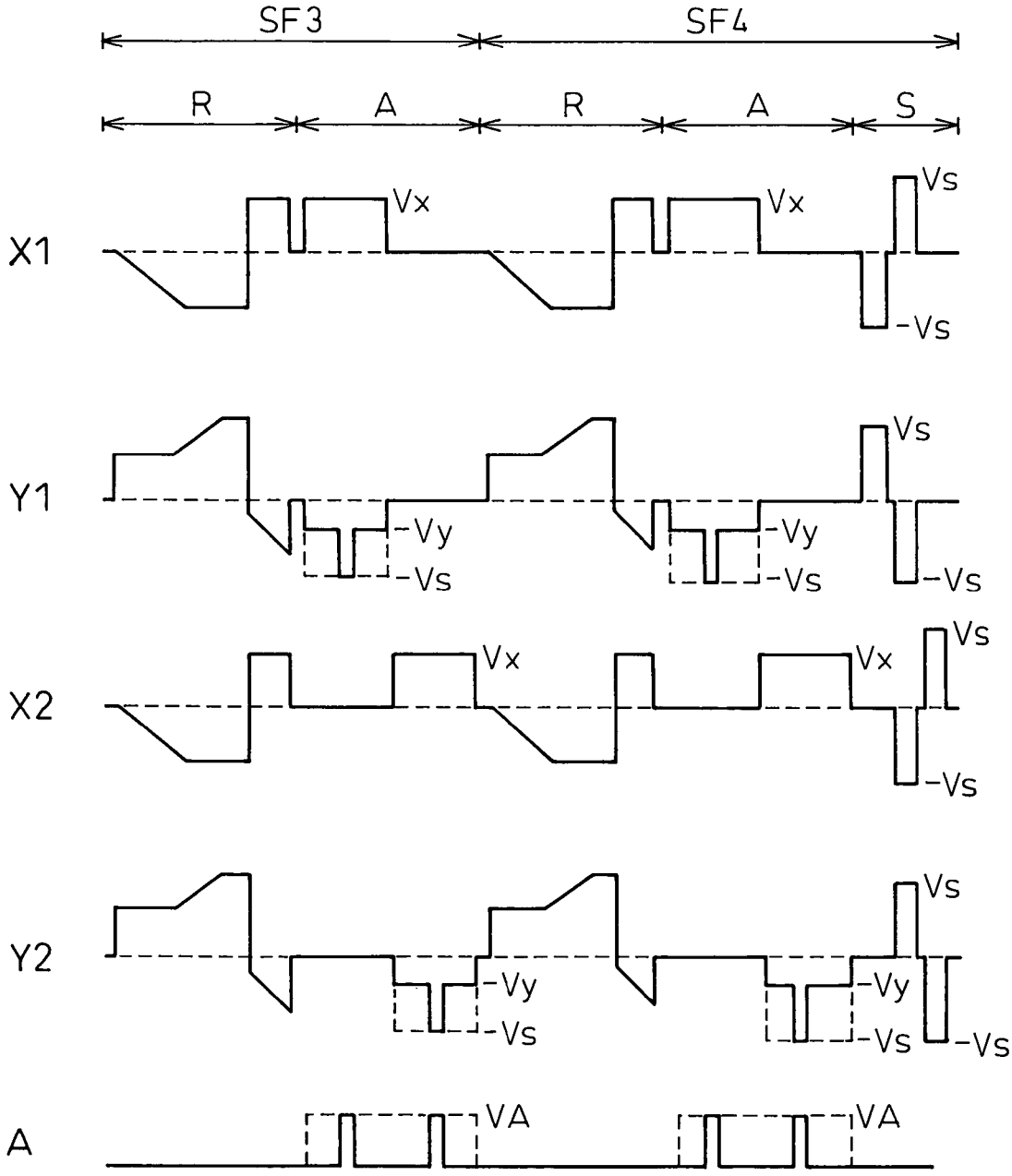
FIG. 13 is a diagram showing other drive waveforms of the PDP apparatus in the second embodiment.

FIG. 12 and FIG. 13 are diagrams showing drive waveforms in the odd number fields SF1 to SF4 in the second embodiment, and X1 represents the waveform to be applied to the odd-numbered X electrodes, X2 represents the waveform to be applied to the even-numbered X electrodes, Y1 represents the waveform to be applied to the odd-numbered Y electrodes, and Y2 represents the waveform to be applied to the even-numbered Y electrodes. The drive waveforms in the even number fields are not shown here. This diagram of the waveforms corresponds to FIG. 7 showing the drive waveforms in the first embodiment and the drive waveforms in the subfield SF5 and the following subfields of higher luminance are the same as those in the subfield SF4 only except for the number of sustain pulses, though not shown here. As shown schematically, no sustain period S is provided in SF1 to SF3. The first, third, fifth, . . . , n-th display lines L1, L5, L9, . . . , L(4n−3) of the odd-numbered display lines are defined between the X1 electrodes and the Y1 electrodes, and the second, fourth, sixth, . . . , n-th display lines L3, L7, L11, . . . , L(4n−1) of the odd-numbered display lines are defined between the X2 electrodes and the Y2 electrodes. For reference, the first, third, fifth, . . . , n-th display lines L2, L6, L10, . . . , L(4n−2) of the even-numbered display lines are defined between the Y1 electrodes and the X2 electrodes and the second, fourth, sixth, . . . , n-th display lines L4, L8, L12, . . . , L4n of the even-numbered display lines are defined between the Y2 electrodes and the X1 electrodes.

First, the drive waveforms in SF4 are explained. As shown schematically, the waveforms applied to the X1 and X2 electrodes, the Y1 and Y2 electrodes, and the address electrodes during reset period R are the same as those in FIG. 3 and FIG. 7, therefore, no explanation is given here. At the end of the reset period, negative wall charges are formed in the vicinity of the Y1 and Y2 electrodes and positive wall charges are formed in the vicinity of the X1 and X2 electrodes and in the vicinity of the address electrodes.

The following address period is divided into a first half period and a second half period, and during the first half period, writing is performed in the first, third, fifth, . . . , n-th display lines L1, L5, L9, . . . , L(4n−3) of the odd-numbered display lines and during the second half period, writing is performed in the second, fourth, sixth, . . . , n-th display lines L3, L7, L11, . . . , L(4n−1) of the odd-numbered display lines.

During the first half period, in a state in which the ground potential is applied to the X2 and Y2 electrodes, the X bias voltage Vx is applied to the X1 electrode, and the Y bias voltage (non-selection potential) −Vy is applied to the Y1 electrode, a scan pulse having the voltage −Vs is applied to the Y1 electrode while the position of application is shifted sequentially and an address pulse having the voltage VA is applied to the address electrode in the cells to be lit in synchronization with the scan pulse. In other words, the same drive waveforms as those in SF4 in the first embodiment are applied to the odd-numbered X1 and Y1 electrodes and the address electrodes. Due to this, an address discharge is caused to occur between the Y1 electrode and the address electrode in the cells to be lit in the first, third, fifth, . . . , n-th display lines of the odd-numbered display lines, and induced by this, an address discharge is caused to occur also between the Y1 electrode and the X1 electrode. As a result, negative wall charges are formed in the vicinity of the odd-numbered X1 electrodes and positive wall charges are formed in the vicinity of the odd-numbered Y1 electrodes.

During the second half of the address period, in a state in which the ground potential is applied to the X1 and Y1 electrodes, the X bias voltage Vx is applied to the X2 electrode, and the Y bias voltage −Vy is applied to the Y2 electrode, a scan pulse having the voltage −Vs is applied to the Y2 electrode while the position of application is shifted sequentially and an address pulse having the voltage VA is applied to the address electrode in the cells to be lit in synchronization with the scan pulse. In other words, the same drive waveforms as those in the SF4 in the first embodiment are applied to the even-numbered X2 and Y2 electrodes and the address electrodes. Due to this, an address discharge is caused to occur between the Y2 electrode and the address electrode in the cells to be lit in the second, fourth, sixth, . . . , n-th display lines of the odd-numbered display lines, and induced by this, an address discharge is caused to occur also between the Y2 electrode and the X2 electrode. As a result, negative wall charges are formed in the vicinity of the even-numbered X2 electrodes and positive wall charges are formed in the vicinity of the even-numbered Y2 electrodes.

In the manner described above, writing is performed in the odd-numbered display lines.

During the sustain period, in a state in which the ground potential is applied to the X2, Y2, and address electrodes, a sustain pulse having the voltage −Vs is applied to the X1 electrode and a sustain pulse having the voltage Vs is applied to the Y1 electrode. Due to this, the voltage 2Vs is applied between the X1 electrode and the Y1 electrode and the voltage due to the wall charges in the vicinity of the X1 and Y1 electrodes is added and thus the discharge start voltage is reached, and a sustain discharge is caused to occur in the cells to be lit in the first, third, fifth, . . . , n-th display lines of the odd-numbered display lines. At this time, the voltage Vs is applied between the Y1 electrode and the X2 electrode, both electrodes defining an even-numbered display line, and between the Y2 electrode and the X1 electrode, both electrodes defining an even-numbered display line, and the voltage due to the wall charges is also added, but no discharge is caused to occur because the discharge start voltage is not reached. Due to the sustain discharge between the X1 electrode and the Y1 electrode in the cells to be lit, positive wall charges are formed in the vicinity of the X1 electrode and negative wall charges are formed in the vicinity of the Y1 electrode. Because no discharge is caused to occur, the wall charges are maintained in the X2 and Y2 electrodes, therefore, the negative wall charges remain in the vicinity of the X2 electrode and the positive wall charges remain in the vicinity of the Y2 electrode.

Next, a sustain pulse having the voltage Vs is applied to the X1 and Y2 electrodes and a sustain pulse having the voltage −Vs is applied to the Y1 and X2 electrodes. In other words, sustain pulses having the opposite phase to each other are applied between the X1 and Y1 electrodes and between the X2 and Y2 electrodes, respectively. As described above, the voltage due to the wall charges in the vicinity of the X1, Y1, X2 and Y2 electrodes serve to increase the voltages between the X1 and Y1 electrodes and between the X2 and Y2 electrodes, therefore, the discharge start voltage is reached and a sustain discharge is caused to occur between the X1 and Y1 electrodes and between the X2 and Y2 electrodes. Due to this discharge, the polarity of the wall charges in the vicinity of the X1, Y1, X2 and Y2 electrodes is reversed. Because no voltage is applied between the Y1 and X2 electrodes and between the Y2 and X1 electrodes, no sustain discharge is caused to occur.

In this manner, if a sustain pulse is applied between the X1 and Y1 electrodes and between the X2 and Y2 electrodes while the polarity of the sustain pulse is reversed in turn, a sustain discharge is caused to occur repeatedly.

The first sustain discharge is caused to occur only between the X1 and Y1 electrodes and not between the X2 and Y2 electrodes, therefore, the number of sustain discharges between the X2 and Y2 electrodes is less than that between the X1 and Y1 electrodes by one. Therefore, at the end of the sustain period, in a state in which the ground potential is applied to the X1 and Y1 electrodes, a sustain pulse having the voltage Vs is applied to the X2 electrode and a sustain pulse having the voltage −Vs is applied to the Y electrode, and thus a sustain discharge is caused to occur only between the X2 and Y2 electrodes. Due to the sustain discharge between the X2 and Y2 electrodes, the polarity of the wall charges in the vicinity of the X2 and Y2 electrodes is reversed and becomes the same polarity as that of the wall charges in the vicinity of the X1 and Y1 electrodes. Due to this, it is possible to erase the wall charges in the lit cells in the preceding subfield by applying a common on-cell reset voltage to all of the X electrodes and an on-cell reset obtuse wave to all of the Y electrodes during the reset period. Two sustain discharges are caused to occur in each of the odd-numbered display lines.

The drive waveforms in the SF3 are those in the SF4 from which the drive waveforms during the sustain period S are excluded and, during the address period A, an address discharge is caused to occur between the X and Y electrodes and wall charges for a sustain discharge are formed, but no sustain discharge is caused to occur. Therefore, the luminance of the SF3 is lower than that of the SF4 by the amount corresponding to one sustain discharge.

The drive waveforms in the SF2 differ from those in the SF3 in that the potential Vx at the X1 and X2 electrodes is changed to the ground potential during the address period A. Because of this, no address discharge is caused to occur between the X electrode and the Y electrode during the address period A and wall charges for a sustain discharge are not formed. Therefore, the luminance of the SF2 is lower than that of the SF3 by an amount corresponding to an address discharge between the X electrode and the Y electrode.

The drive waveforms in the SF1 differ from those in the SF2 in that the voltage VA1 of an address pulse is lower than the voltage VA. Because of this, the intensity of an address discharge between the Y electrode and the address electrode is reduced, therefore, the luminance of the SF1 is lower than that of the SF2 by the amount corresponding to the reduction in the intensity of an address discharge.

The operation in the SF4 in the odd number field is explained as above, but in the even number field, the drive waveform of the X1 electrode is applied to the X2 electrode, and the drive waveform of the X2 electrode is applied to the X1 electrode.

In the second embodiment, a modification in which the potential of the X electrode during the address period is changed or the modification in which instead of the change of the voltage of an address pulse to VA1, the voltage of a scan pulse is changed, both explained in the first embodiment, are also applicable.

As described above, in the subfield configuration of the PDP apparatus in the second embodiment, three subfields of different luminances lower than the minimum luminance of the subfield having the sustain period are provided, therefore, the display of low-luminance gradations will be improved.

Figure 14:
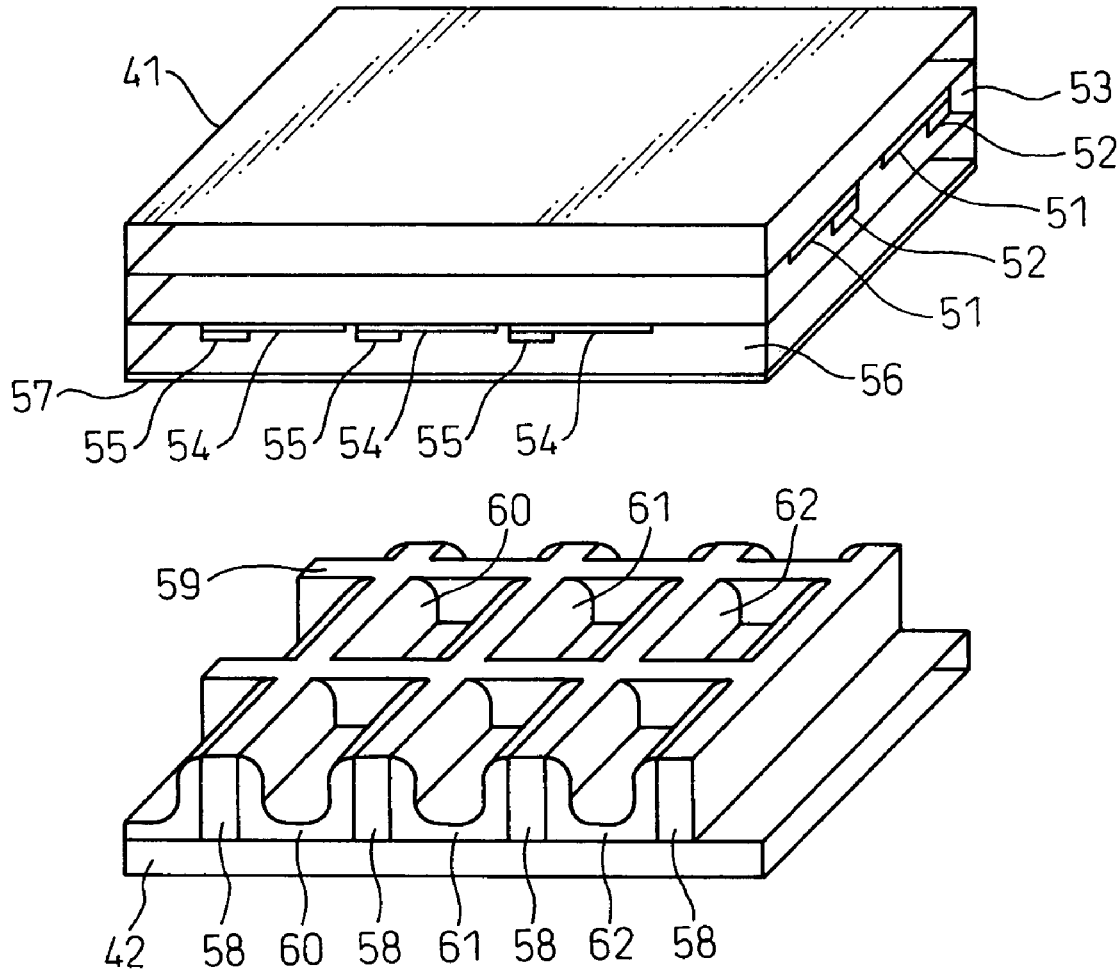
FIG. 14 is an exploded perspective view of a PDP used in a third embodiment of the present invention.

FIG. 14 is an exploded perspective view of a PDP used in the third PDP apparatus in the third embodiment of the present invention. The third embodiment is an embodiment in which the present invention is applied to a two-electrode type PDP apparatus. Two-electrode type plasma display panels (PDPS) include a type in which the intersecting electrodes are formed on one of the substrates and another type in which they are formed on the facing substrate. In the present embodiment, the present invention is applied to the type in which the intersecting electrodes are formed on one of the substrates. However, the present invention is not limited to this, but can also be applied to the type in which the intersecting electrodes are formed on the facing substrate.

In the two-electrode type PDP, as shown in FIG. 14, a group of transverse electrodes (first electrodes) consisting of transparent electrodes 51 and bus electrodes 52 are arranged in parallel on a transparent substrate 41, a dielectric layer 53 covers them, a group of longitudinal electrodes (second electrodes) extending in a direction perpendicular to the group of transverse electrodes and consisting of transparent electrodes 54 and bus electrodes 55 are arranged in parallel thereon, a dielectric layer 56 is further formed thereon, and a protective layer 57 such as MgO is provided thereon. On a back substrate 42, a two-dimensional partition consisting of partitions 58 extending in the longitudinal direction and partitions 59 extending in the transverse direction is provided, and phosphors 60, 61, 62 are applied to the back substrate 42 and the sides of the partitions.

Figure 15:
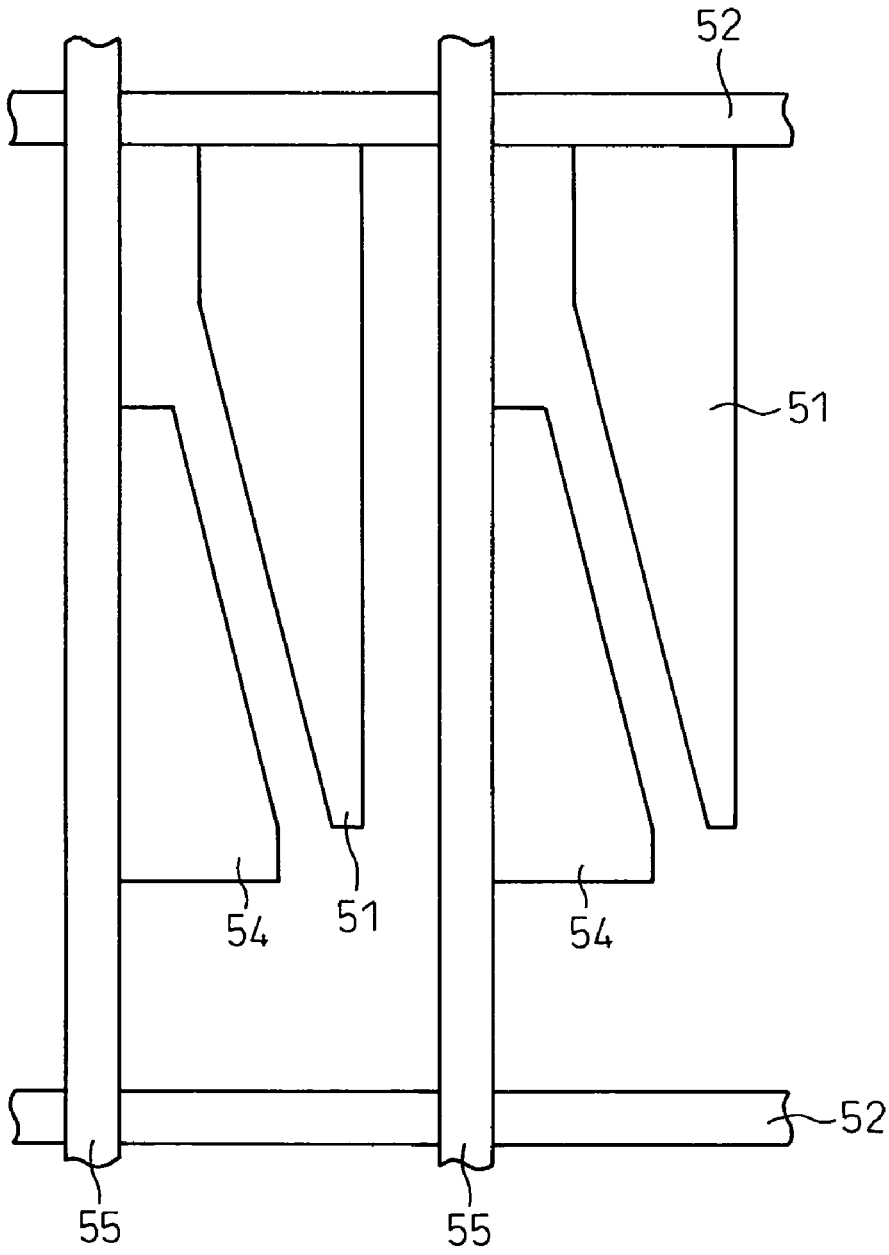
FIG. 15 is a diagram showing the shapes of electrodes in the PDP in the third embodiment.

FIG. 15 is a diagram showing the electrode shapes of the PDP shown in FIG. 14. As shown schematically, the edge of the transverse transparent electrode 51 protrudes from the transverse bus electrode 52 and the edge of the longitudinal transparent electrode 54 protrudes from the longitudinal bus electrode 55, so as to face each other at a predetermined distance, and a discharge can be caused to occur between the transverse transparent electrode 51 and the longitudinal transparent electrode 54. As the partitions are provided so as to overlap the transverse bus electrodes 52 and the longitudinal bus electrodes 55, respectively, no discharge is caused to occur between the transverse bus electrodes 52 and the longitudinal bus electrodes 55.

Figure 16:
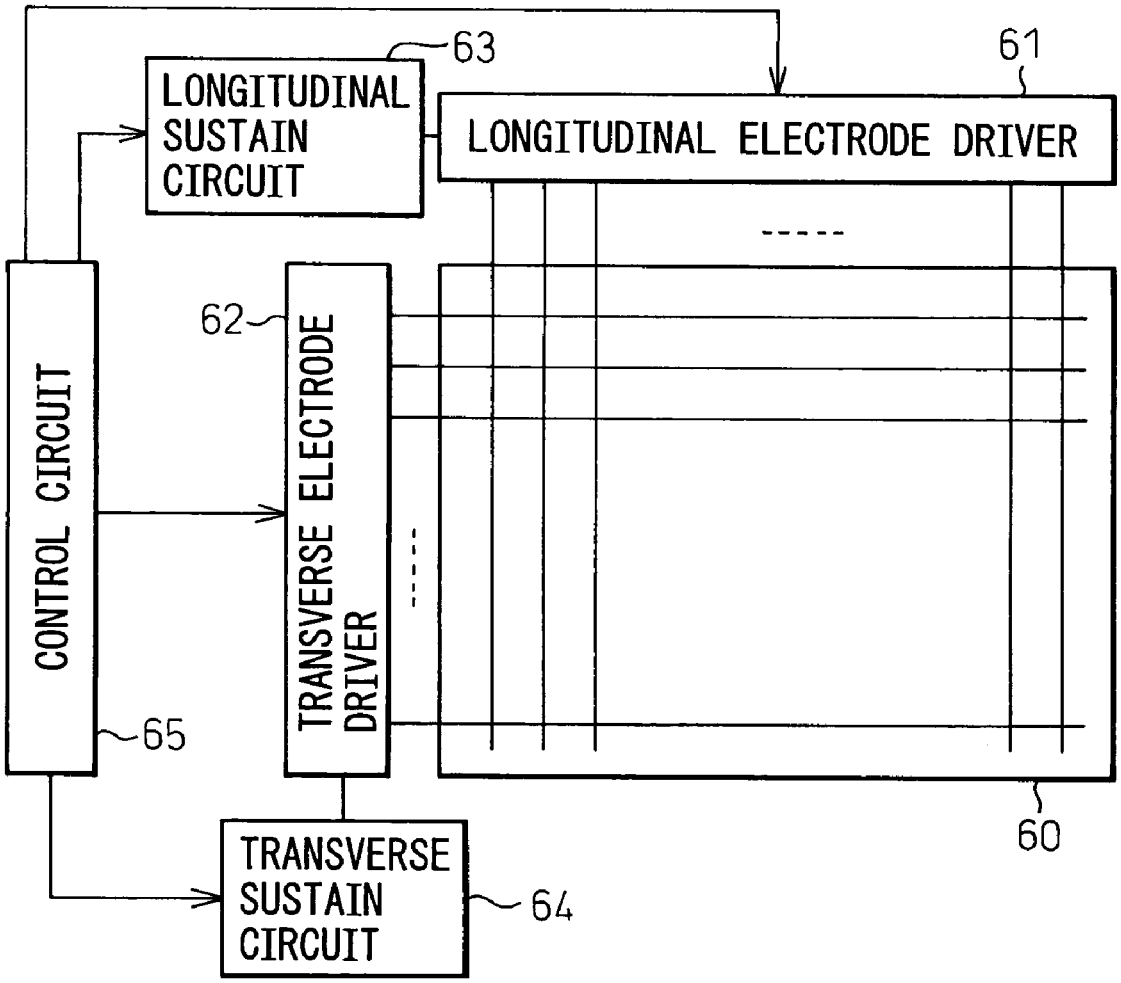
FIG. 16 is a diagram showing a general configuration of a PDP apparatus in the third embodiment.

FIG. 16 is a diagram showing the general configuration of the PDP apparatus in the third embodiment. A longitudinal electrode driver 61 applies a predetermined voltage supplied from a longitudinal sustain circuit 63 to the longitudinal electrodes as well as applying an address pulse to the longitudinal electrodes of a PDP 60, respectively. A transverse electrode drive 62 applies a predetermined voltage supplied from a transverse sustain circuit 64 to the transverse electrodes as well as applying a scan pulse to the transverse electrodes of the PDP 60, respectively. A control circuit 65 controls each component.

Figure 17:
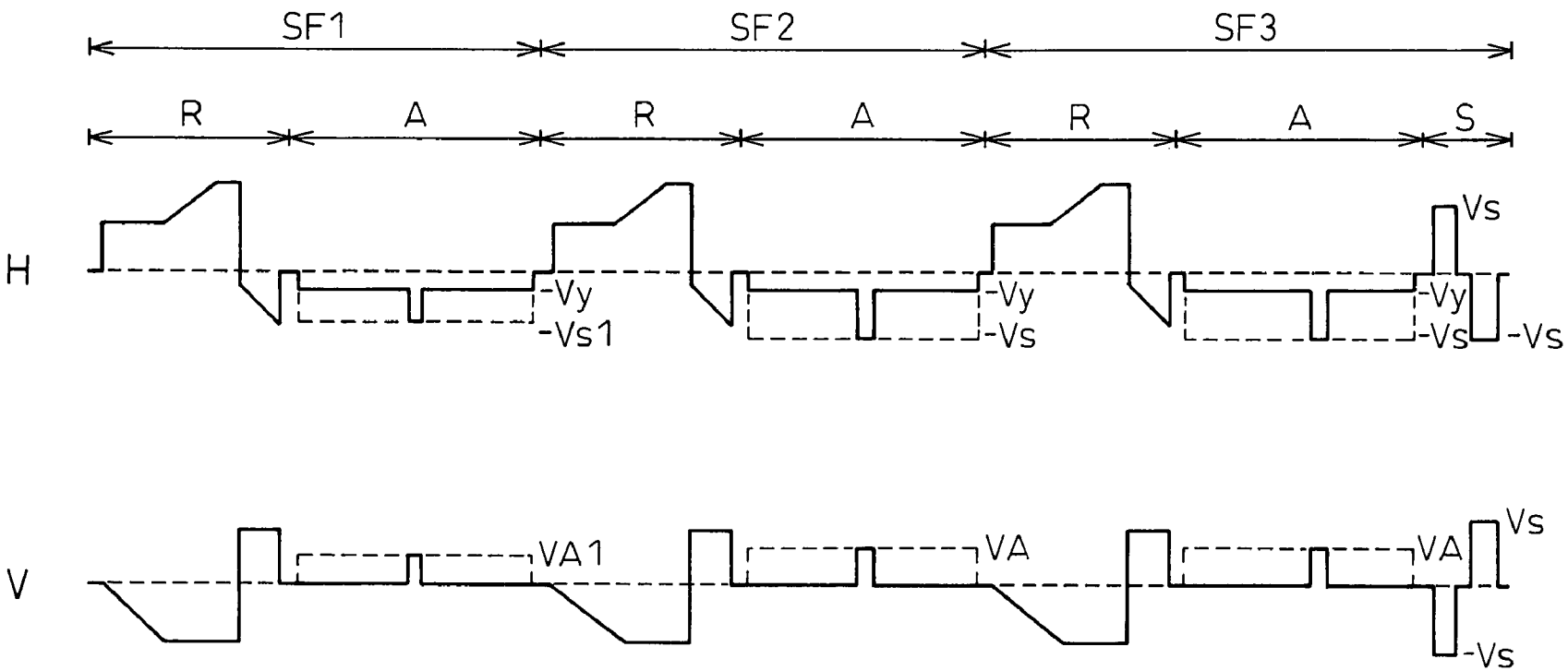
FIG. 17 is a diagram showing drive waveforms in the PDP apparatus in the third embodiment.

FIG. 17 is a diagram showing drive waveforms in the third embodiment, and H represents a waveform to be applied to the transverse electrodes and V represents a waveform to be applied to the longitudinal electrodes. This diagram of the waveforms corresponds to FIG. 7 showing the drive waveforms in the first embodiment. The drive waveforms in the subfield SF4 and following subfields of higher luminance are, though not shown here, the same as those in the SF3 except in that the number of sustain pulses is different. As shown schematically, no sustain period S is provided in the SF1 and SF2.

First the drive waveforms in the SF3 are explained. As shown schematically, the waveforms to be applied to the transverse electrodes and the longitudinal electrodes during the reset period R are similar to the waveforms to be applied to the X electrodes and the Y electrodes in FIG. 3 and FIG. 7. Therefore, during the reset period, the wall charges, in the cells lit in the preceding subfield, are erased and, at the same time, the same wall charges are formed in all of the cells.

During the address period A, in a state in which the bias voltage −Vy is applied to the transverse electrodes and the ground potential is applied to the longitudinal electrodes, a scan pulse having the voltage −Vs is applied to the transverse electrodes while the position of application is shifted sequentially, and an address pulse having the voltage VA is applied to the longitudinal electrodes in the cells to be lit in synchronization with the scan pulse. Due to this, an address discharge is caused to occur in the cells to be lit and wall charges for selectively causing a sustain electrode to occur are formed. In this case, positive wall charges are formed in the vicinity of the transverse electrodes and negative wall charges are formed in the vicinity of the longitudinal electrodes in the cells to be lit.

During the sustain period S, a sustain pulse having the voltage Vs is applied to the transverse electrodes and a sustain pulse having the voltage −Vs is applied to the longitudinal electrodes. By the addition of the voltage due to the wall charges, to the voltage of the sustain pulses, the discharge start voltage is exceeded and a sustain discharge is caused to occur. Due to sustain discharge, the polarity of the wall charges is reversed and, therefore, when a sustain pulse whose polarity has been reversed is applied, a sustain discharge is caused to occur again. After this, if a sustain pulse is applied repeatedly while the polarity is reversed by turns, a sustain discharge is caused to occur repeatedly.

SF2 differs from SF3 in that the sustain period S is not provided. Because of this, wall charges for a sustain discharge are formed during the address period A, but no sustain discharge is caused to occur, therefore, the luminance of the SF2 is lower than that of the SF3 by the amount corresponding to a sustain discharge.

SF1 differs from SF2 in that the voltage of a scan pulse is changed from −Vs to −Vs1 (Vs1 is less than Vs) and the voltage of an address pulse is changed from VA to VA1 (VA1 is less than VA). Because of this, the voltage to be applied between the transverse electrode and the longitudinal electrode when an address discharge is caused to occur in a cell to be lit becomes smaller and, therefore, the intensity of an address discharge is reduced. As a result, the luminance of the SF1 becomes lower than the luminance of the SF2 by the amount corresponding to the reduction in the intensity of an address discharge.

As described above, in the subfield configuration of the PDP apparatus in the third embodiment, two subfields of different luminance lower than the minimum luminance of the subfield having the sustain period are provided and, therefore, the display of low-luminance gradations is improved.

According to the present invention, as the minimum luminance of the subfield can be further reduced, the display of low-luminance gradations is improved and the quality of the display is improved.

Moreover, according to the present invention, the quality of display in a plasma display apparatus can be improved and, in particular, the displaying performance of low-luminance gradations, which is thought to be inferior to that of a CRT, can be improved and, therefore, it is probable that the plasma display apparatus will gain more general acceptance.

We claim:

1. A plasma display apparatus, comprising first and second groups of electrodes arranged on a first substrate in parallel to each other and a third group of electrodes arranged on a second substrate facing the first substrate so as to intersect the first and second groups of electrodes, wherein one frame is made up of a plurality of subfields and the plurality of subfields includes a first subfield group having an address period during which an address discharge is caused to occur to select cells to be lit and a sustain period during which a sustain discharge is caused to occur in the cells selected during the address period; and a second subfield group having an address period but not a sustain period, wherein the address period in the first subfield group includes a first subfield in which, after an address discharge is caused to occur between the second group of electrodes and the third group of electrodes, an address discharge is caused to occur between the first group of electrodes and the second group of electrodes, and wherein the address period in the second subfield group includes a second subfield in which the address discharge is caused to occur between the second group of electrodes and the third group of electrodes, without a transition of this address discharge to that between the first group of electrodes and the second group of electrodes and a third subfield in which, after the address discharge is caused to occur between the second group of electrodes and the third group of electrodes, the address discharge is caused to occur between the first group of electrodes and the second group of electrodes.

2. The plasma display apparatus as set forth in claim 1, wherein a subfield having a least luminance weight in the second subfield group is the second subfield.

3. The plasma display apparatus as set forth in claim 1, wherein, during the address period in the second subfield, the potential of the first group of electrodes is set to ground potential.

4. The plasma display apparatus as set forth in claim 1, wherein, during the address period in the second subfield, the potential of the first group of electrodes is set to a non-selection potential during the address period in the second group of electrodes.

5. The plasma display apparatus as set forth in claim 1, wherein, during the address period in the second subfield, the potential of the first group of electrodes is set to ground potential and, during the address period in the third subfield, the potential of the first group of electrodes is set to a positive potential.

6. The plasma display apparatus as set forth in claim 1, wherein, the luminance weight of the subfield of the second subfield group is less than that of the subfield of the first subfield group, and when an address discharge is caused to occur in the subfield having the least luminance weight, the potential of the first group of electrodes is set to ground potential.

7. The plasma display apparatus as set forth in claim 1, wherein, the luminance weight of the subfield of the second subfield group is less than that of the subfield of the first subfield group and, when an address discharge is caused to occur in the subfield having the least luminance weight, the potential of the first group of electrodes is set to a non-selection potential during the address period in the second group of electrodes.

* * * * *